United States Patent [19]

Husted

[11] Patent Number: 4,850,153

[45] Date of Patent: Jul. 25, 1989

[54] GEAR DRIVEN ROTARY WHEEL RETAINER

[76] Inventor: Royce H. Husted, 711 Lakeside Dr., Wheaton, Ill. 60187

[21] Appl. No.: 208,376

[22] Filed: Jun. 17, 1988

Related U.S. Application Data

[63] Continuation-in-part of Ser. No. 54,533, May 27, 1987, abandoned.

[51] Int. Cl.[4] ..... B24B 41/00

[52] U.S. Cl. ..... 51/168; 279/8

[58] Field of Search ..... 51/168; 279/1 A, 1 W, 279/8

[56] References Cited

U.S. PATENT DOCUMENTS

| | | | |
|---|---|---|---|
| 2,586,530 | 2/1952 | Godfrey | 51/168 |
| 2,704,426 | 3/1955 | MacAulay | 51/168 |
| 4,551,902 | 11/1985 | Thibaut | 51/168 |

FOREIGN PATENT DOCUMENTS

| | | | |
|---|---|---|---|
| 530784 | 12/1976 | U.S.S.R. | 51/168 |

*Primary Examiner*—Roscoe V. Parker

*Attorney, Agent, or Firm*—Nicholas A. Camasto

[57] ABSTRACT

A work wheel retainer includes a flange having an annular recess for receiving a spur gear having an inner threaded surface for threadingly engaging the threaded end of an arbor. The work wheel is sandwiched between an arbor flange and a retainer flange and the spur gear is driven along the threads of said arbor by a manually operated axle-less pinion gear. The retainer flange includes a pair of counter bores communicating with the annular recess, either of which may be used to secure the pinion gear in position for rotating the spur gear. Another embodiment for use with an internally threaded arbor includes a screw portion integrally formed with, or affixed to, the spur gear.

8 Claims, 2 Drawing Sheets

GEAR DRIVEN ROTARY WHEEL RETAINER

This application is a continuation-in-part of application Ser. No. 054,533, filed 5/27/87, now abandoned.

BACKGROUND OF THE INVENTION AND PRIOR ART

This invention relates generally to rotary power tools and specifically to means for attaching rotary work wheels thereto.

Presently, saw blades and grinding wheels, hereinafter referred to collectively as work wheels, are secured to the tool arbor or shaft by means of a washer and a suitable fastener. If the arbor has an external thread, a nut may be used as a fastener and if the arbor has an internal thread, a bolt may be used. In some instances in bench mounted grinders, for example, a thick, internally threaded washer with two holes in the washer face, for accommodating a spanner wrench, is used in place of a nut. In either case, a wrench is needed to tighten the threaded fastener to the threaded arbor or to remove the threaded fastener from the arbor. The arbor is rotatable and coupled to the drive gearing of the tool and, since most rotary tools are relatively free-turning, it is generally necessary to use two wrenches in counter rotation to tighten or loosen the threaded fastener. The second wrench must be placed over a hex drive head on the arbor flange, into a hole in the arbor itself or into holes in the arbor washer, all of which are located behind the work wheel. Consequently, the work wheel totally blocks visibility, and it is very difficult to position the second wrench. When the second wrench is properly installed, the operator must push on one wrench and pull on the other while his hands straddle the sharp or highly abrasive work wheel. Dislodgement of either wrench can result in injury to the operator from the sharp or abrasive work wheel.

Most rotary power tools are designed to self-tighten when in use, i.e. when the work wheel engages the workpiece, the resisting force acts to further tighten the threaded fastener. Under a heavy workload, the threaded fastener can become extremely tight and make its removal even more difficult and strenuous for the operator. The difficulty and potential for injury involved has resulted in machinists evolving their own methods of changing work wheels. One is to position a spanner wrench on the arbor nut and manually accelerate the wheel to drive the wrench handle into the wheel guard to loosen the threaded fastener. A series of such impacts may loosen the threaded fastener. Another method is to bang the end of the positioned spanner wrench with a hammer. While both methods are relatively simple and generally effective to loosen the threaded fastener, they can adversely affect the rotary tool. In a surface grinder, for example, damage may occur to the highly precisioned arbor bearings by the shock loads transmitted to them, which could materially reduce bearing life. Also, the sudden shock loads are very destructive to the so-called "live coupling" that transfers the rotary motion from the tool motor to the arbor.

The situation with respect to portable power tools, such as rotary power saws, is not much better because there is no ready access to the rear side of the blade, which is fitted with a keyed hole that matches a flange piece mounted to the shaft. The blade itself must therefore be held secure while a wrench or special tool is used to tighten the nut. Because of the keyed arrangement, restraining the blade prevents rotation of the saw gear train and motor shaft and permits the fastener to be tightened or loosened. Many haphazard and often dangerous techniques are used to hold the blade. A long, relatively thin object, such as a screwdriver, is often used to wedge the toothed blade against the saw housing to prevent movement during tightening and loosening. The object may be inserted through a hole (if available) in the side of the blade, or more usually wedged between a pair of saw teeth. While this technique could also have adverse effects on the saw, it is preferable to holding the sharp saw blade with one's hand.

The prior art has developed a number of effective techniques for removing threaded fasteners from arbors. Some commercial saws include a button-operated device that internally stops the arbor from rotating and eliminates the need for a second wrench. This system is built into the power tool and, of course, adds to the tool's complexity and cost. A fastening device similar to that of the present invention is shown in U.S. Pat. No. 2,704,426. That device uses a pinion gear to drive a spur gear that in turn threadingly engages the arbor. The spur gear loads a bearing plate that is keyed to the arbor and includes a hole for locating the end of the pinion gear adjacent to the spur gear.

The patented device has a short extension shaft on the end of the pinion gear that cooperates with the hole in the bearing plate to position and retain the pinion gear and spur gear in engagement. Operational ease requires some clearance or "play" between the extension shaft and the hole and between the teeth of the pinion gear and spur gear, which makes for an awkward arrangement. The two meshing gears tend to push apart when loaded. Because the pinion gear is retained at one end only, a cocking condition occurs that results in binding and excessive wear. The need for the extension shaft also severely restricts the minimum size of the device. Downsizing the patented device to fit hand power saws, for example, would result in an extremely fragile extension shaft. A thick bearing plate is required to provide a deep enough hole for the extension shaft to bear in. This adds to the overall thickness of the device which creates a clearance problem on many circular saws and hand-held power tools.

With the construction of the invention, however, the spur gear and the entire pinion gear are captivated in counter bores in the bearing plate. The pinion gear teeth actually bear against the walls of the cutout. The resulting novel axle-less gear drive permits very reliable operation without the need for close tolerances, and can be used in very small devices.

Thus, with the present invention, the problem of replacing work wheels on rotary tools is overcome in a very effective manner. Not only is the system of the invention simple, compact and inexpensive, it captivates the axle-less drive pinion gear during operation. Further the arrangement of the drive pinion gear and the spur gear in a recessed flange plate is not only compact, but enables smooth, controlled application of torque. The inventive construction is therefore eminently suited for use with portable rotary power tools.

OBJECTS OF THE INVENTION

A principal object of the invention is to provide an improved rotary work wheel fastener.

Another object of the invention is to provide a simple, easy-to-install rotary work wheel fastener.

A feature of the invention is the use of an axle-less pinion gear as the drive means in the fastener.

BRIEF DESCRIPTION OF THE DRAWINGS

These and other objects and advantages of the invention will be apparent upon reading the following description in conjunction with the drawings, in which like reference numerals denote like parts and in which.

DESCRIPTION OF THE PREFERRED EMBODIMENT

Figure 1:
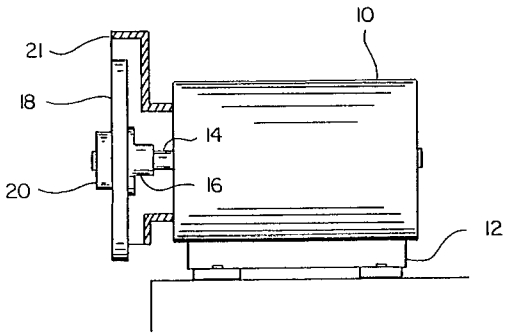
FIG. 1 illustrates a typical motorized grinder utilizing the fastener of the invention.

In FIG. 1, a motor 10 includes mounting feet 12 for affixing it to a bench or the like. A rotatable shaft or arbor 14 projects from one end of motor 10 and carries a fixed arbor flange 16 thereon. A work wheel 18 is mounted over the end of the arbor and is sandwiched between arbor flange 16 and fastener means 20 of the invention. A suitable safety guard 21 is shown in cross-section and is situated in close proximity to work wheel 18.

Figure 2:
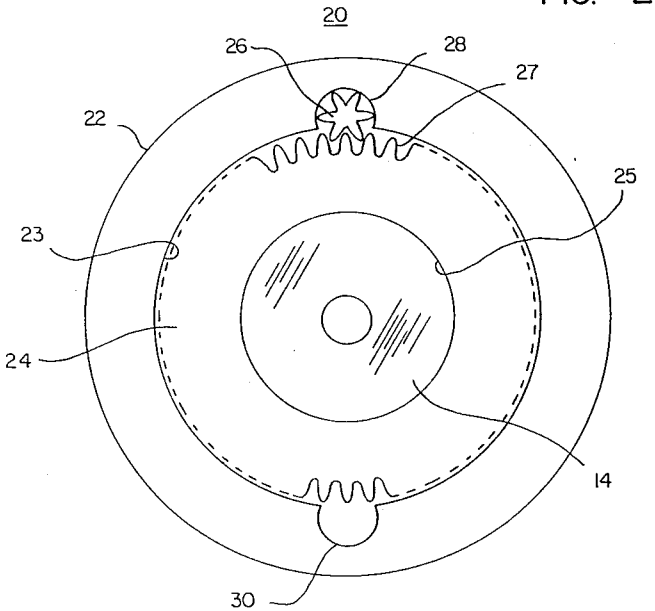
FIG. 2 is an enlarged partial end view of the fastener of the invention.

FIG. 2 illustrates an end view of the two-piece fastener means 20 of the invention. A cup-shaped annular flange 22 defines a circular cutout or recess 23 in which a spur gear 24 may rotate. Gear 24 includes a threaded inner surface 25, adapted to threadingly engage a similarly threaded end of arbor 14, and peripheral teeth 27. Flange 22 also includes a pair of diametrically opposed recesses or counter bores 28 and 30 in either of which a tool with a pinion gear 26 formed on the end thereof may be inserted for driving engagement with the teeth 27 of spur gear 24. It will be appreciated that pinion gear 26 may also be loosely held within counter bore 28 and turned by means of a conventional screwdriver or hex-head wrench. Similarly, pinion gear 26 may be loosely held by means of an overlying lip on the front of flange 22 or on the top face of spur gear 24.

Figure 3:
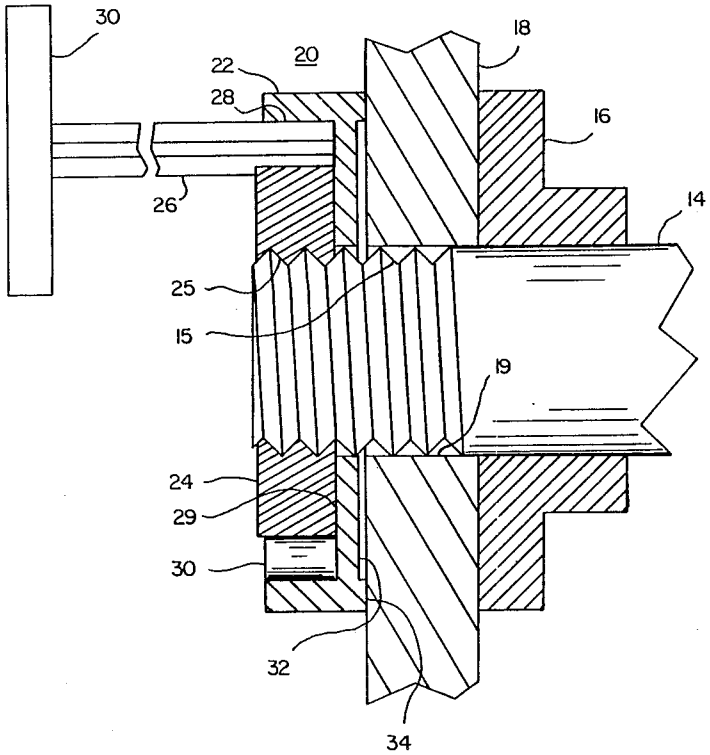
FIG. 3 is a partial sectional view of the fastener of the invention installed on an arbor.

FIG. 3 illustrates the arrangement of parts more clearly. As shown, arbor 14 includes an externally threaded end 15 which engages the threaded inner surface 25 of gear 24. Work wheel 18 is shown sandwiched between arbor flange 16, which is securely affixed to arbor 14, by any suitable and well-known means, and the bottom portion 29 of flange 22. It will be seen that bottom portion 29 defines the circular recess 23 in flange 22 and has an inner diameter 25 that is larger than the diameter of arbor 14 and smaller than the outer diameter of spur gear 24 such that when gear 24 is threadingly engaged on threaded end 15 of arbor 14, flange 22 is securely held against work wheel 18. Pinion gear 26 terminates in a handle 30 which may be conveniently used to rotate it to drive spur gear 24 and to tighten or loosen the fastener means on arbor 14.

In operation, work wheel 18 may be rapidly and conveniently changed with one hand. To remove a work wheel, hand held pinion gear 26 is inserted into counter bore 28 (or counter bore 30) into meshing engagement with the peripheral teeth on spur gear 24 and rotated in the proper angular direction to cause threaded inner surface 25 to loosen on threaded end 15 of arbor 14. Once loose, pinion gear 26 can be removed and the operator need merely spin spur gear 24 and flange 22 off the remaining threads of the arbor and remove the work wheel. A new work wheel 18 is positioned over the arbor and the concentric annular flange 22 and spur gear 24 are threaded by hand until flange 22 sandwiches the work wheel 18 between it and the arbor flange 16. The hand-held tool with pinion gear 26 is inserted into counter bore 28 (or counter bore 30) into engagement with the teeth of the spur gear 24 and the operator rotates pinion gear 26 until the flange 22 is firmly driven into engagement with work wheel 18. When the flange is properly secured, the pinion gear 26 is removed. The entire procedure can be carried out without requiring access to any part of the mechanism except the work wheel and the exposed portion of the arbor. Further, it may be accomplished quickly and reliably and simply by the operator.

The one-hand operation is made possible by ass ring that the friction force between the spur gear 24 and the flange 22 is less than the friction force between the flange 22 and the work wheel 18 and further that the friction force between the flange 22 and the work wheel 18 is less than that between the work wheel 18 and the arbor flange 16. If the frictional relationship is not as specified, when the pinion gear 26 is rotated, either the spur gear 24 and flange 22 will tend to rotate or the spur gear 24, flange 22 and work wheel 18 will tend to rotate, which may require the operator to grasp one or the other of these devices until the frictional relationship mentioned above obtains.

The underside of bottom portion 29 of flange 22 may be undercut to form an annular recess 32 to concentrate the forces exerted by flange 22 against wheel 18 at an annular load surface 34. In general, grinding wheels and the like have a paper-type material affixed to their central surface areas to enhance the frictional characteristics thereat. In rare instances it may be desirable to insert a large friction washer between flange 22 and work wheel 18 to assure that the frictional relationships mentioned above are obtained.

It is naturally beneficial to have a minimum frictional load between the inner threaded surface 25 of spur gear 24 and threaded end 15 of arbor 14. It is also desirable to have a low friction force contact between the flat engaging surfaces of spur gear 24 and flange 22. These ends may be best attained by having smooth surface finishes on hardened steel surfaces. As mentioned, in special cases such as when dealing with certain types of hardened steel saw blades, it may be difficult to obtain enough friction force between the arbor flange and the flange of the invention to reliably tighten the gear. In those rare instances, a friction material may be bonded to the faces of flange 22 and arbor flange 16.

Another technique for reliably holding flange 22 rotatably stationary relative to arbor 14 is to form an axial key slot in threaded end 15 and to provide a protruding key on the inside diameter of bottom portion 29 of flange 22 for sliding in the slot formed in the threaded end. While this is a positive technique for securing flange 22 against rotation, it is not ideal since most machine tools do not have the key slot formed in the threaded end of the arbor and would thus require modification.

A feature of the invention is the axle-less pinion gear of the tooth to tooth diameter of which is slightly smaller than the diameter of the counter bore. The counter bore thus serves as a bearing surface for the pinion gear 26 with the tips of the pinion gear teeth bearing against the interior wall of the counter bore such that the counter bore holds the pinion gear in mesh with the teeth 27 of spur gear 24. The counter bore also provides angular support to pinion gear 24 as it is being manually rotated. This arrangement of an axle-less pinion gear dramatically reduces the tolerance requirements for the various parts and does away with the need for an extension shaft on the pinion gear. While other gear ratios are contemplated, a ratio of 8:1 for a surface grinder proved satisfactory.

Figure 5:
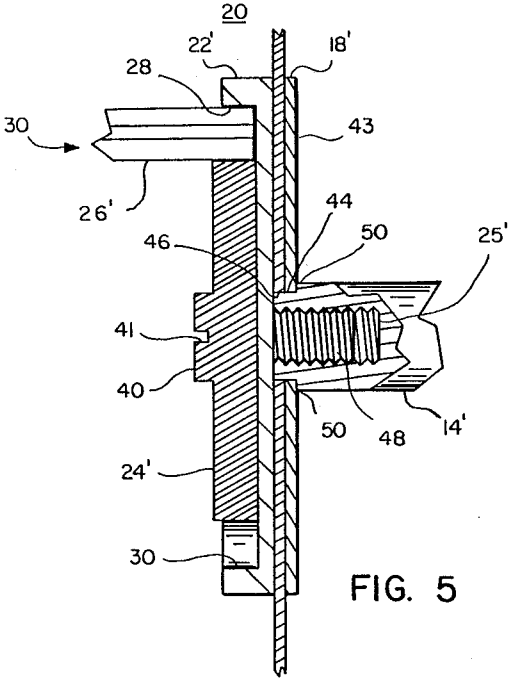
FIG. 5 is an end view of the apparatus of FIG. 4.
Figure 4:
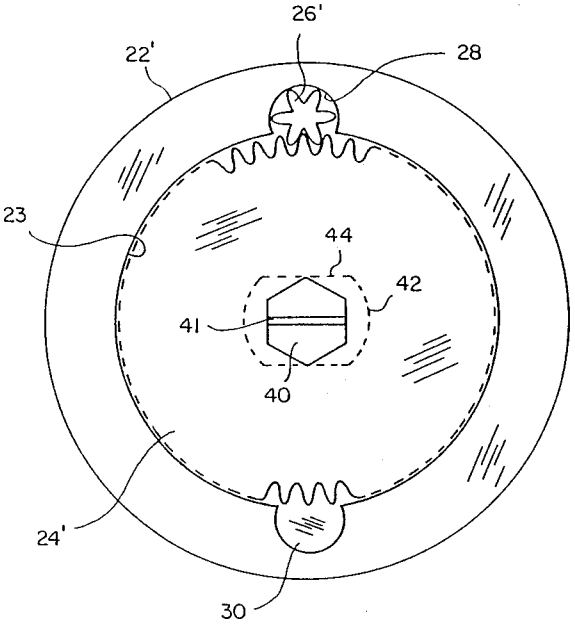
FIG. 4 is a partial end view of a different version of the inventive fastener used with an internally threaded arbor.

FIGS. 4 and 5 represent views similar to FIGS. 2 and 3 showing the invention as adapted for use in connection with an arbor that includes an internally threaded portion and a "double-D" end configuration such as is commonly used in portable rotary saws. Annular flange 22' is configured with a double-D shaped orifice 42 (shown in dashed lines on FIG. 4) with flats 44 and 46 defining the double-D configuration. Spur gear 24' includes a unitary threaded portion 48 that engages a mating threaded hole 25' in the end of arbor 14'. A backing plate 43, which also includes a matching double-D configuration, is positioned on the end of arbor 14' adjacent a circumferential shoulder 50. A saw blade 18' with a suitably sized orifice is positioned over the end of arbor 14' adjacent backing plate 43 and is sandwiched between backing plate 43 and the bottom of annular flange 22'.

Operation of the fastening means of the invention in this embodiment is identical to that previously described with the exception that spur gear 24' engages an inner threaded portion of the arbor rather than an outer threaded portion. A hexagonal head 40, including a screwdriver slot 41, is optionally formed on the outer surface of spur gear 24' to enable loosening of the fastening means of the invention should tool 30 be misplaced. It will be appreciated by those skilled in the art that spur gear 24' may be fitted with a suitable bolt to replace the integral arrangement of head 40 and threaded portion 48, the criterion being that a rigid relationship be maintained between these parts. As shown in FIGS. 4 and 5, the inventive construction lends itself to downsizing without loss of effectiveness and operating ease. High torque applications can readily be accommodated since the diameter of the axle-less pinion gear 26 may be made quite small without loss of strength and durability. In a practical application for a hand power saw, the axle-less pinion gear had a root diameter of 0.10 inches and a face (height) of approximately 0.23 inches. The pinion gear had six teeth and a pressure angle of approximately 20°. The spur gear in one embodiment had a face height of 3/16 inches, a diameter of approximately 0.80 inches and 24 teeth with a 20° pressure angle. The gear ratio was 4:1. In another embodiment of higher torque, the face height was 0.25 inches, the diameter was approximately 1.30 inches and it had 40 teeth with the same pressure angle. While the same pinion gear was used, the flanges in the two embodiments were sized to accommodate the different spur gears. This gear ratio was nearer 7:1.

Figure 6:
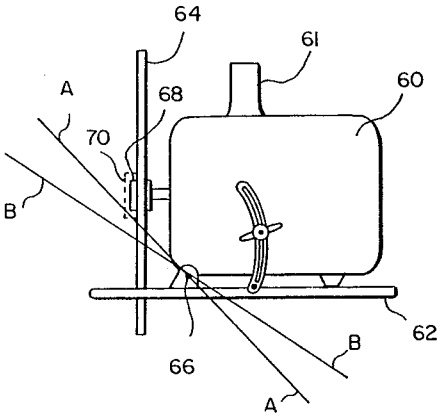
FIG. 6 illustrates the importance of the small size of the inventive fastener on the utility of a power saw.

FIG. 6 illustrates the importance of keeping the size of the fastener small. A typical saw with a body 60, a handle 61, a tiltable base 62 hinged to the body at 66, drives a saw blade 64. A fastener 68 is seen to limit the tilting of base 62 to line A—A, which is approximately 45° with respect to blade 64. As indicated by dotted line block 70, a larger fastener will limit the angle of tilting to line B—B, which is significantly less than 45°. This is an important consideration in making a tool compact and is a critical one when providing fasteners for the after market, i.e. for saws that already are in the consumer's possession. As mentioned, the fastener of the invention is extremely compact, yet is capable of high torque and easy, reliable operation.

It is recognized that numerous changes and modifications in the described embodiment of the invention will be apparent to those skilled in the art without departing from its true spirit and scope. The invention is to be limited only as defined in the claims.

What is claimed is:

1. A locking arrangement for removing and installing a rotary work wheel on a threaded an arbor by means of a drive pinion, said arbor including a flange means, comprising:

gear means for threadingly engaging said arbor, and having circumferential teeth;

flange means defining an annular recess larger than the diameter of said gear means and forming an orifice larger than the diameter of said arbor such that said flange mean at least partially nests with said gear means; and counter bore means in said flange means having a diameter that is slightly larger than the diameter of said drive pinion for locating said drive pinion in operative relationship with said circumferential teeth of said gear means.

2. The arrangement of claim 1 wherein the frictional force between said gear means and said flange means is less than the frictional force between said flange means and said rotary work wheel.

3. The arrangement of claim 2 wherein said arbor is externally threaded and wherein said gear means has an inner threaded hole for engaging said externally threaded arbor.

4. The arrangement of claim 2 wherein the gear ratio between said gear means and said drive pinion is approximately 8:1.

5. The arrangement of claim 2 wherein said arbor is internally threaded and wherein said gear means has a fixed protruding stud for engaging said internally threaded arbor.

6. The arrangement of claim 5 wherein the gear ratio between said gear means and said drive pinion is in a range of approximately 4:1 to 7:1.

7. In combination in a gear driven threaded retainer;

an arbor including a threaded surface;

an arbor flange mounted on said arbor;

a work wheel positioned on said arbor in engagement with said arbor flange;

a retainer flange positioned on said arbor adjacent said work wheel, said retainer flange including an annular recess;

a spur gear having a threaded portion matingly engaging said threaded surface of said arbor, said spur gear closely nesting in said annular recess of said retainer flange;

a pinion gear adapted for engagement with said spur gear;

a counter bore in said retainer flange for rotatably retaining said pinion gear in engagement with said spur gear; and said pinion gear, when manually rotated, creating tangential forces on said spur gear to removably secure said spur gear, said retainer flange and said work wheel to said arbor.

8. The combination of claim 7 wherein said counter bore in said retainer flange communicates with said annular recess and has a diameter slightly larger than the diameter of said pinion gear.

* * * * *